US005761784A

United States Patent [19]

Ogle et al.

[11] Patent Number: 5,761,784

[45] Date of Patent: Jun. 9, 1998

[54] METHOD OF MANUFACTURING A POCKETED SPRING ASSEMBLY

[75] Inventors: Steven E. Ogle; Thomas J. Wells, both of Carthage, Mo.

[73] Assignee: L&P Property Management Co., South Gate, Calif.

[21] Appl. No.: 821,393

[22] Filed: Mar. 20, 1997

Related U.S. Application Data

[62] Division of Ser. No. 682,104, Jul. 17, 1996, Pat. No. 5,669,093.

[51] Int. Cl.[6] ..... B68G 7/00; A47C 27/04

[52] U.S. Cl. ..... 29/91.1; 5/420

[58] Field of Search ..... 29/91.1, 428, 91; 5/720, 722, 655.8, 716

[56] References Cited

U.S. PATENT DOCUMENTS

| | | | |
|---|---|---|---|
| 1,153,120 | 9/1915 | Lackey | 5/722 |
| 1,434,653 | 11/1922 | Fiss et al. . | |
| 1,502,510 | 8/1924 | Marcus et al. . | |
| 3,230,558 | 1/1966 | Duncan | 5/720 |
| 4,234,984 | 11/1980 | Stumpf . | |
| 4,523,344 | 6/1985 | Stumpf et al. | 5/720 |
| 4,854,023 | 8/1989 | Stumpf | 29/91 |
| 4,907,309 | 3/1990 | Breckle . | |
| 4,942,636 | 7/1990 | Scott et al. . | |
| 4,985,952 | 1/1991 | Edelson . | |
| 5,086,529 | 2/1992 | DeGroot | 5/722 |
| 5,127,635 | 7/1992 | Long et al. | 267/91 |
| 5,438,718 | 8/1995 | Kelly et al. | 29/91.1 |

FOREIGN PATENT DOCUMENTS

| | | | |
|---|---|---|---|
| 1194621 | 3/1982 | Canada . | |
| 089789A1 | 10/1983 | European Pat. Off. . | |
| 357912A1 | 10/1989 | European Pat. Off. . | |
| 421496A1 | 2/1990 | European Pat. Off. . | |
| 945591 | 6/1956 | Germany | 5/722 |
| 016914A1 | 11/1981 | Germany . | |
| 831510A1 | 5/1989 | Germany . | |
| 1247 | of 1904 | United Kingdom . | |
| 759177 | 10/1956 | United Kingdom | 5/722 |
| 2143731 | 7/1984 | United Kingdom . | |
| 318141 | 7/1990 | United Kingdom . | |

*Primary Examiner*—Alexander Grosz

*Attorney, Agent, or Firm*—Wood, Herron & Evans, L.L.P.

[57] ABSTRACT

A method of manufacturing a pocketed coil spring assembly comprising vertically spacing two sheets of fabric apart so that the sheets are generally parallel to one another. The sheets are then attached together along one end edge and rows of coil springs are inserted between the sheets. After each row of coil springs is inserted between the sheets, the sheets are attached together along transversely extending lines of attachment in alternative planes of the pocketed coil spring assembly. These steps of inserting rows of coil springs and attaching the sheets together in alternative planes occurs sequentially until an appropriate length of the assembly is obtained.

6 Claims, 5 Drawing Sheets

METHOD OF MANUFACTURING A POCKETED SPRING ASSEMBLY

CROSS-REFERENCE TO RELATED APPLICATIONS:

This application is a Division of U.S. application Ser. No. 08/682,104 filed Jul. 17, 1996, now U.S. Pat. No 5,669,093 entitled Pocketed Coil Spring Assembly and assigned to the assignee of this application, which application is herein incorporated by reference in its entirety.

FIELD OF INVENTION

This invention relates to spring assemblies for mattresses, cushions and the like and more particularly to pocketed coil spring assemblies.

BACKGROUND OF THE INVENTION

One well known type of spring interior of a mattress or cushion comprises a plurality of individual coil springs arranged in linear fashion into rows and columns and secured within fabric pockets. The fabric material of the pockets is commonly sewn, welded, glued or otherwise secured so as to enclose the individual coil springs or a row of coil springs within a pocket of fabric material. The individual pocketed coil springs or rows of coil springs are then secured together with either adhesive applied to the exterior of the pocketed material or fasteners which pass through the fabric and the end turns of adjacent coil springs.

It is generally acknowledged that a pocketed coil spring assembly is a more expensive product than a conventional unpocketed spring assembly because a pocketed coil spring assembly requires more labor and material to assemble than does a non pocketed coil spring assembly. A pocketed coil spring assembly is said to have a "softer" more luxurious feel to it without giving up any of the resilience of a conventional coil spring assembly. Also the noise and rubbing of adjacent coil springs with each other is minimized or eliminated. The result is said to be a superior, quieter, but more expensive product for the consumer.

U.S. Pat. No. 4,523,344 discloses a pocketed coil spring assembly in which each coil spring is enclosed within a pocket and rows of these pockets are arranged in longitudinally extending blocks 12. The blocks 12 may be hingedly connected to one another either in the middle of the blocks or in either the top or bottom planar surface of the pocketed coil spring assembly. This type of hinged pocketed coil spring assembly gives the assembly flexibility and enables the assembly to bend in at least one direction. However, one problem with this type of arrangement of blocks of pocketed coil springs is that if the coil springs within the blocks are tall enough, the blocks of coils springs have a tendency to fall over to one side like dominos when the unit is compressed.

Continuous bands of coil springs rather than individual coil springs may also be pocketed in a "softer", more expensive product than conventional unpocketed coil spring assemblies. As seen in U.S. Pat. No. 5,127,635 issued to the assignee of the present invention, this type of pocketed coil spring assembly utilizes transversely or longitudinally extending bands of coil springs made of one continuous piece of wire, each band being enclosed in a fabric cover to form a block. Within each block individual pockets encasing one or more coil springs of a band may be formed by connecting opposite sides of the fabric together between individual coil springs. In U.S. Pat. No. 5,127,635 two coil springs are included within each pocket but any number of coil springs within a band may be pocketed simply by connecting opposite sides of the fabric block together at selected points along the length of the row. The fabric pockets are adhesively secured together with a conventional adhesive with or without individual foam pieces inserted between the rows of pockets.

In U.S. Pat. No. 5,438,718, there is disclosed a pocketed spring assembly wherein complete rows of coil springs formed from a single wire are contained in individual pockets of the pocketed spring unit. This patent also discloses a method and apparatus for automatically manufacturing this so-called continuous spring pocketed spring assembly. It has been found, though, that spring assemblies made in accordance with the disclosure of U.S. Pat. No. 5,438,718 must be of very limited height and that the springs contained within the pockets cannot be of standard spring height of approximately 5" or greater because the complete assembly when compressed has a tendency for the individual rows of springs to roll over upon each other in a domino like effect. This is very objectionable and has heretofore precluded commercialization of the spring assembly except in very low height and substandard height mattresses.

It has therefore been one objective of this invention to provide a new mattress spring assembly wherein complete rows of pocketed springs may be contained within individual pockets without the domino effect causing tipping the springs toward one side when the spring assembly is compressed.

Yet another objective of this invention has been to provide a method of manufacture of pocketed springs which may be easily automated in which there is no tendency for the rows of pocketed springs when compressed to roll over and collapse in a domino like fashion.

It has been a further objective of the present invention to provide an improved pocketed coil spring assembly which is inherently capable of folding and yet may be made of full standard height, which is ideal for an adjustable bed mattress.

Another objective of this invention has been to provide a pocketed coil spring assembly in which the height of the unit is not limited by the domino effect causing tipping of the assembly upon compression of the unit.

SUMMARY OF THE INVENTION

The invention of this application which accomplishes these objectives comprises a pocketed coil spring assembly comprising a plurality of transversely extending integrally connected fabric blocks. Each block contains a row of coil springs which are linearly arranged across the mattress. Each coil spring has a first and second end turn and a plurality of convolutions between the end turns defining an axis of the coil spring. Each block is defined between a first and second sheet of fabric by transversely extending lines of attachment of the sheets to each other. The lines of attachment are alternatively located in the upper and lower planer surfaces of the pocketed coil spring assembly with successive lines of attachment being alternatively located in the upper and lower surfaces of the assembly. In each planar surface of the assembly adjacent lines of attachment are separated by two blocks of coil springs. This type of arrangement allows the coil spring assembly to fold and unfold naturally, the lines of attachment functioning as hinges connecting the blocks of coil springs together.

In order to more securely connect adjacent blocks to each other, fasteners may be used to connect adjacent end turns of adjacent coil springs in one of the planar surfaces of the assembly. Typically these fasteners are metal hog rings but may be any other conventional fastener. With the fasteners each block is connected to an adjacent block by a line of attachment in one planar surface and at least one fastener in the other planar surface. The blocks of the coil springs may be further connected to each other with an upper and lower rectangular border wire disposed in the planar surfaces of the assembly, the border wires being secured to the end turns of the outermost coil springs.

In one preferred embodiment of the present invention, a continuous band of coil springs is inserted into each block. The band of coil springs is made of a single piece of wire formed into a plurality of coil springs innerconnected with innerconnecting segments. Different kinds of bands such as those disclosed in U.S. Pat. No. 4,358,097 or that disclosed in British Patent No. 2,143,731 may be utilized. The bands of coil springs are oriented oppositely so that the assembly does not have a tendency to fall over toward one side or the other when collapsed. This opposite orientation of adjacent bands results in greater stability of the assembly and enables the bands of coil springs to be of greater height than heretofore possible in continuous band pocketed coil springs such as those disclosed in U.S. Pat. No. 5,438,718.

Alternatively in the practice of this invention, individual coil springs may be utilized within a block rather than a band of coil springs. If individual coil springs are used, the coil springs are preferably separated from one another with a plurality of spaced seams which interconnect two sheets of fabric along lines of connection located between the upper and lower surfaces of the assembly. The lines of attachment separating the blocks from one another in alternate top and bottom planes of the assembly and the lines of connection separating individual coil springs from one another may be sewn seams, ultrasonically welded seams, or adhesively secured seams, or a combination thereof.

DETAILED DESCRIPTION OF THE INVENTION

Figure 1:
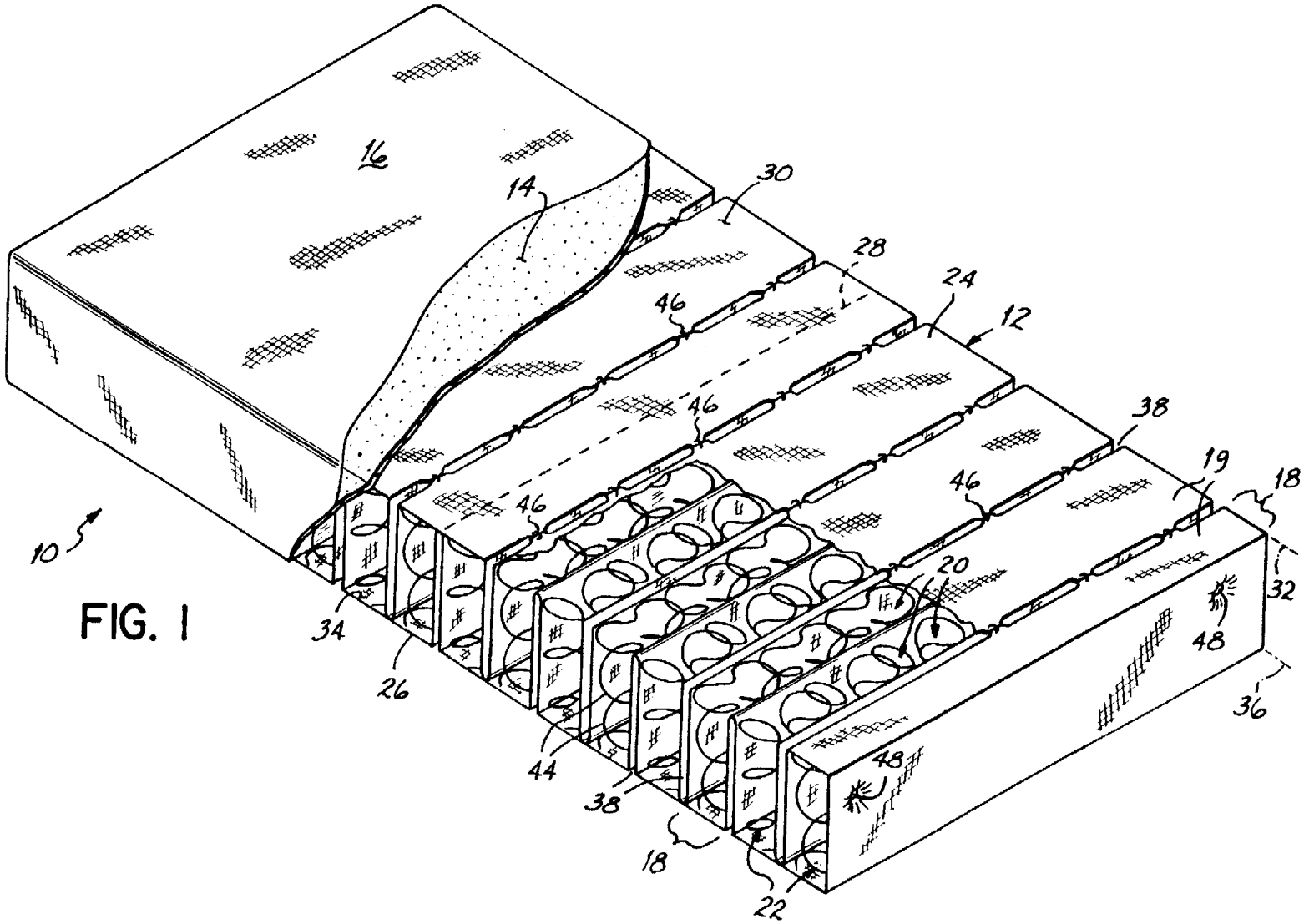
FIG. 1 is a perspective view of the pocketed coil spring assembly of the present invention.

With reference to FIG. 1 there is illustrated a mattress 10 comprising a pocketed spring assembly 12, a mattress pad 14 covering at least one surface of the pocketed spring assembly 12 and an upholstered covering 16 encasing the mattress pad 14 and pocketed coil spring assembly 12.

Figure 4:
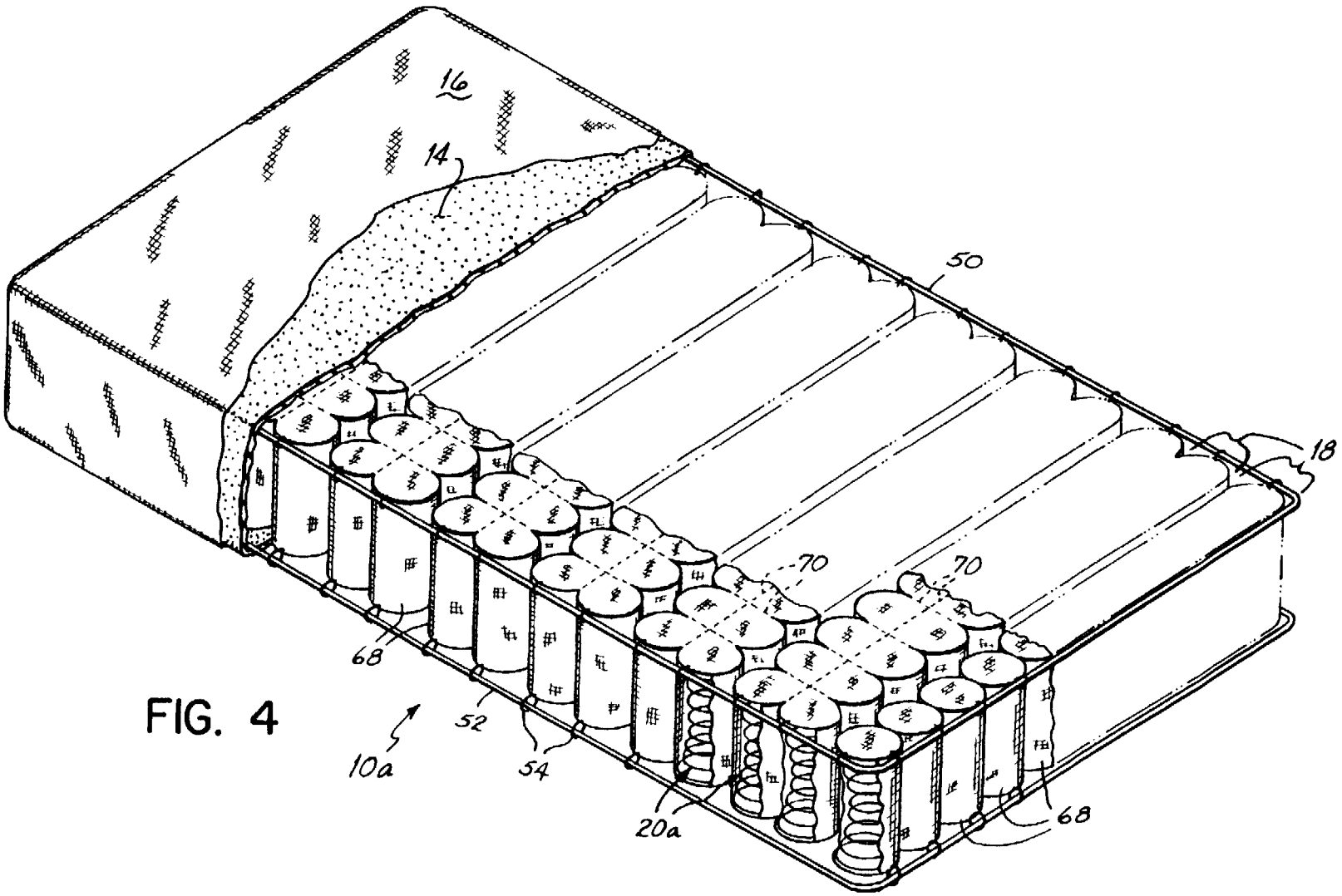
FIG. 4 is a perspective view of an alternative embodiment of the present invention in which individual coil springs rather than a band of coil springs are contained within each block of the assembly.

The pocketed spring assembly of the present invention comprises a plurality of transversely extending integrally connected fabric blocks 18. Within each block 18 are a plurality of coil springs 20 arranged in a linear row 19. The coil springs 20 may be part of a continuous band 22 of coil springs as seen in FIG. 1 or may be separated from one another so that each individual coil spring 20 is isolated from the adjacent coil springs as seen in FIG. 4. The blocks 18 are defined by two sheets of fabric, an upper sheet 24 and a lower sheet 26 between which lie the rows 19 of coil springs 20. The sheets 24, 26 are connected together along transversely extending lines of attachment 28 which function as hinges connecting adjacent blocks.

The coil spring assembly 12 has an upper planar surface 30 in a top plane 32 and a lower planar surface 34 in a bottom plane 36. The lines of attachment 28 between adjacent blocks 18 are located in the upper and lower planar surfaces 30,34 of the assembly. The lines of attachment 28 are alternatively located in the upper and lower planar surfaces 30,34 of the assembly such that in either planar surface two blocks 18 of coil springs 20 lie between adjacent lines of attachment 28.

As seen in FIG. 1, in order to the hold the assembly in an assembled position and prevent the assembly from unfolding, a plurality of fasteners 46 may be used to hold the blocks 18 together. The fasteners 46 are located in the two planar surfaces 30, 34 of the assembly. These fasteners 46 are shown as metal hog rings which pass through the fabric of the blocks 18 and the end turns 40, 42 of the coil springs 20 in order to secure adjacent blocks 18 together but may be any other type of fastener. FIG. 1 illustrates five such fasteners 46 securing two adjacent blocks 18 together, but any number of fasteners may be used. The fasteners 46 are located oppositely of the lines of attachment 28 so that two adjacent blocks 18 are connected in one of the planar surfaces with a line of attachment 28 and in the other planar surface with at least one fastener 46.

In order to prevent the bands of springs or individual coil springs from moving laterally within a block 18, spot welds 48 as seen in FIG. 1 may be used to secure the two sheets 24, 26 of fabric together between the central convolutions 44 of adjacent coil springs. Alternatively, as seen in FIG. 4, an upper border rod 50 and a lower border rod 52 may be used to secure the coil springs together and prevent their lateral movement. The border rods 50, 52 are secured to the outermost coil springs with any conventional fastener such as hog rings 54.

If bands 22 of coil springs are inserted into the blocks 18 of the assembly rather than individual coil springs, the bands 22 may be of any configuration. One kind of band, a so called continuous band of springs is disclosed in U.S. Pat. No. 4,358,097 assigned to the assignee of this application. Another kind of band is disclosed in British Patent No. 2,143,731. Both of the bands of springs disclosed in these patents comprise a single length of wire shaped to form a plurality of individual coil springs 20 arranged in a row, one end turn of each coil spring lying adjacent to a top face 58 of the band 22 and the other end turn of each coil spring lying adjacent to a bottom face 60 of the band. The coil springs 20 of the bands of springs 22 disclosed in both of these patents are interconnected to adjacent coils by a pair of interconnecting segments 56 of wire located in the bottom and top faces 58, 60 of the bands. Each interconnecting segment 56 comprises a longitudinally extending bridging portion 62 of the band of springs which extends lengthwise of the row and a pair of endmost portions 64 which extend transversely from opposite ends of the bridging portion (see FIG. 6A). In U.S. Pat. No. 4,358,097 the bridging portion 62 of the interconnecting segment 56 has a V-shaped nose 66 midway between the endmost portions 64 of each interconnecting segment 56. Adjacent bands of coil springs are oriented oppositely so that the bridging portions of the interconnecting segments in either planar surface of the assembly abut one another and provide an anchor for fasteners 46 to pass through to hold the blocks together. This opposite orientation of bands of coil springs prevents the blocks of coil springs from tilting over in one direction or the other and provides additional stability to the assembly as a whole. This unique orientation of the bands of coil springs enables taller bands to be inserted within the blocks 18 than has heretofore been possible.

A posturized product may be created by making the transversely extending bands 22 of coil springs of differing gauge wire. For example, the center portion of the mattress 10 may be constructed of bands 22 of coil springs of heavier gauge wire than the bands 22 of coil springs 20 at either of the end portions of the mattress, creating a firmer zone in the middle portion or zone of the mattress.

FIG. 4 illustrates an alternative embodiment of the present invention in which a row of individual coil springs rather than a continuous band of coil springs is located within each block 18 of the mattress 10*a*. Each block 18 of coil springs 20*a* is separated into a plurality of individual pockets 68, each pocket 68 containing at least one coil spring 20*a*. FIG. 4 illustrates one coil spring 20*a* within each pocket 68, but alternatively a pocket 68 may contain more than one coil spring 20*a*. The pockets 68 are formed in part by lines of connection 70 which connect the two sheets 24, 26 of fabric together between the coil springs and extend substantially vertically. Like the lines of attachment 28 located between adjacent blocks 18 of the assembly, the lines of connection 70 between adjacent coil springs 20*a* may be sewn seams, ultrasonically welded seams or adhesively secured seams or any combination thereof.

Figure 5:
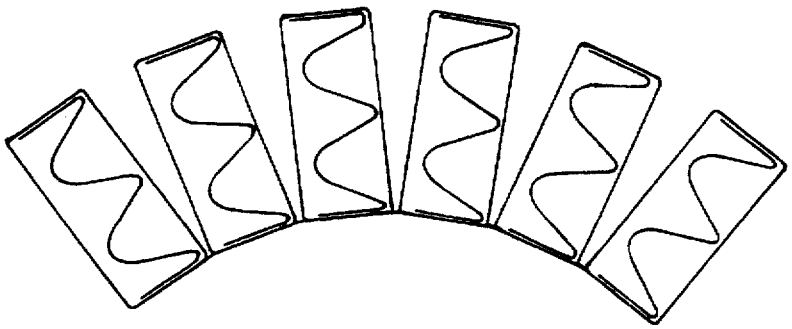
FIG. 5 PRIOR ART
FIG. 5 is a diagrammatic side elevational view of a partial section of a prior art pocketed spring assembly illustrating a plurality of blocks all hingedly connected on one surface of the assembly.

The hinged connections or lines of attachment 28 between blocks 18 of coil springs 20 being alternatively located in the top and bottom planes 32, 36 of the assembly allows the assembly to fold and unfold between a collapsed and expanded position. (see FIG. 2). Between each block of coil springs is a fold 38, the folds being located alternatively in the fabric sheets 24, 26 of the assembly. As seen in FIG. 5 and disclosed, for example, in U.S. Pat. No. 4,523,344, in the prior art assemblies all the blocks were hingedly connected to each other with the hinges all being in the same plane, the bottom plane in FIG. 5, and the springs all similarly oriented within the blocks. This type of arrangement of the blocks of coil springs results naturally from the automatic manufacture of the coil springs and assembly thereof within the fabric blocks 18. As a result, the blocks of the prior art tend to lean over and fall one way or the other, depending upon the orientation of the springs inside the blocks of fabric, upon compression of the springs. In the past, this tendency for this type of assembly to fall over to one side upon compression of the springs has limited the height of the coil springs which could be connected within the blocks to create a commercially acceptable mattress.

Figure 2:
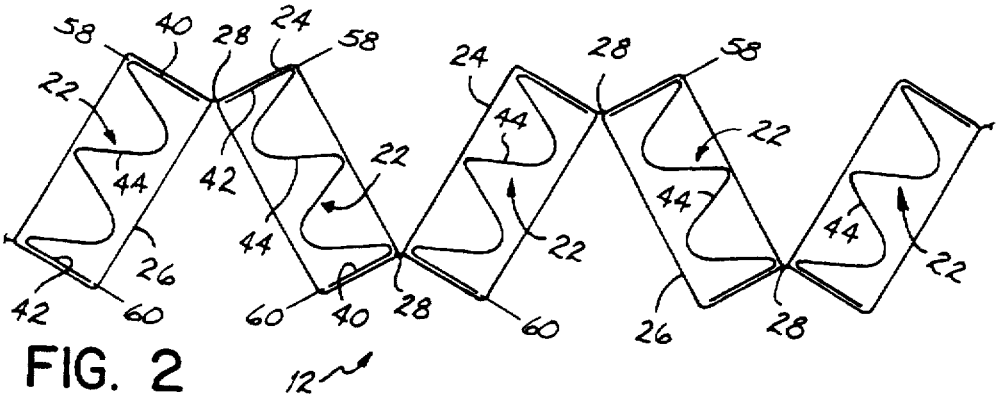
FIG. 2 is a partially diagrammatic expanded side elevational view of a partial section of the pocketed coil spring assembly of FIG. 1.

As best seen in FIG. 2, each coil spring 20 has a first end turn 40 and a second end turn 42 between which are a plurality of central convolutions 44. Typically, all the coil springs within a row of coil springs are identically oriented, all the first end turns 40 being located in either the upper or lower planar surface 30, 34 of the assembly and all the second end turns 42 naturally located in the other planar surface of the assembly.

In the present invention all coil springs 20 within a row 19 are identically oriented. However, adjacent rows of coil springs are oriented oppositely or 180° out of phase. As seen in FIG. 2, every other row 19 of coil springs 20 are oriented such that the interconnecting segments 56 between adjacent end turns 40 of adjacent coil springs 20 are located on opposite sides of the rows of the assembly. For example, if when viewed from the end of the row, all of the interconnecting segments 56 (see FIG. 6A) between adjacent end turns 40 are located on the right side of the row, all of the interconnecting segments 56 of adjacent end turns 42 in the next adjacent row will be located on the left side of the row. This opposite orientation of adjacent rows of coil springs balances the rows and prevents the tipping of the assembly upon compression of the springs of the assembly, thereby increasing the stability of the assembly. Consequently the height of the coil springs which may be used in the assembly in accordance with the practice of this invention is substantially greater than was heretofore possible in pocketed spring assemblies in which the springs of the adjacent rows of the assembly were not balanced by opposite orientation.

Figure 3:
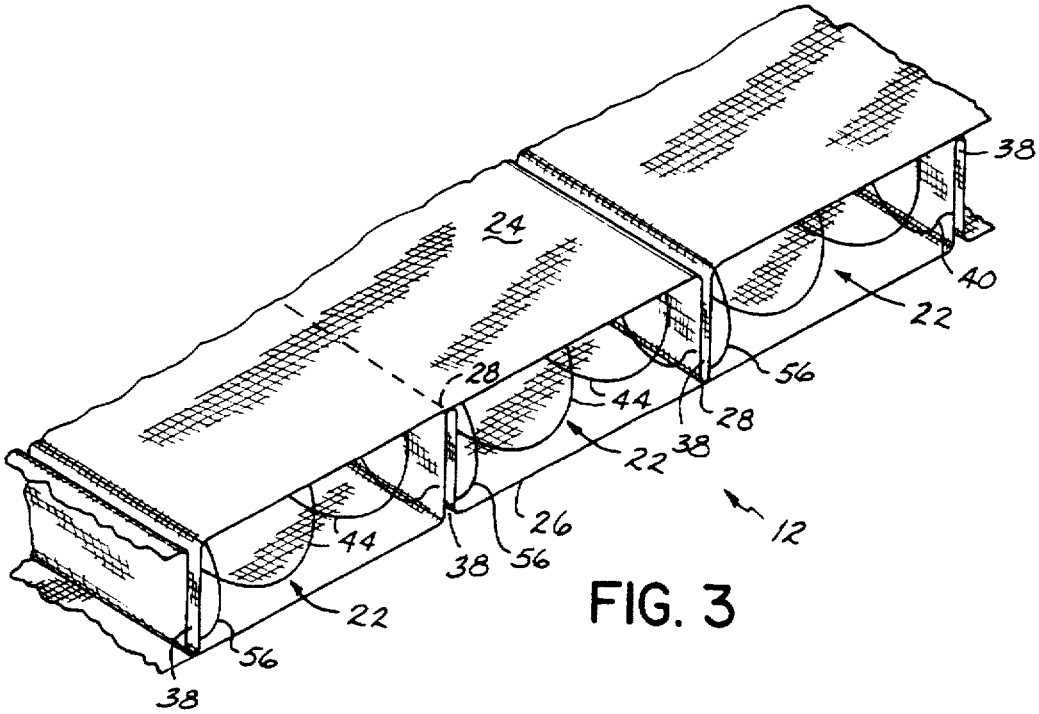
FIG. 3 is an enlarged perspective side elevational view of a portion of the coil-spring assembly of FIG. 2 prior to folding of the assembly into a partially collapsed position of FIG. 2 or a fully collapsed position of FIG. 1.

If instead of bands of springs in which all springs of each row are formed from a single length of wire, as in FIGS. 1–3, the springs of each row are individual coil springs 20 formed from a separate length of wire knotted at each end as in FIG. 4, according to the practice of this invention, all of the knots of the springs in a single row would be oriented on one side of the row (at least in one of the top and bottom planes, but possibly in both) and the knots of the springs in the adjacent rows would be oriented on the opposite side when viewed from the end of the row. In this way, the rows of individual knotted springs would be balanced to achieve the same beneficial results heretofore described relative to the continuous row of pocketed springs.

In order to appreciate how this opposite orientation of springs is achieved utilizing conventional customized spring making and assembly apparatus and machines, it will be seen in FIG. 3 that due to the unique configuration of the lines of attachment 28 alternatively located in the upper and lower planar surfaces 30,34 of the assembly, the assembly may be expanded outwardly into an expanded position with the coil springs 20 lying on their sides rather than their ends. In this expanded configuration of the pocket assembly, it will be seen that the coil springs 20 of all rows are all oriented similarly with the interconnecting segments 56 between end turns 40 of all coil springs 20 located in the same common plane, the top plane in FIG. 3. The two sheets of fabric 24, 26 are substantially parallel to one another with the exception of the folds 38 which alternate between the top and bottom sheets. To form the folds 38 either the top sheet 24 is pressed downwardly to the bottom sheet 26 or the bottom sheet 26 pressed upwardly to the top sheet 24 and a line of attachment 28 made to secure the sheets together. The line of attachment 28 may be either a sewn seam, an adhesively secured seam or an ultrasonically welded seam, or any combination thereof.

Figure 6A:
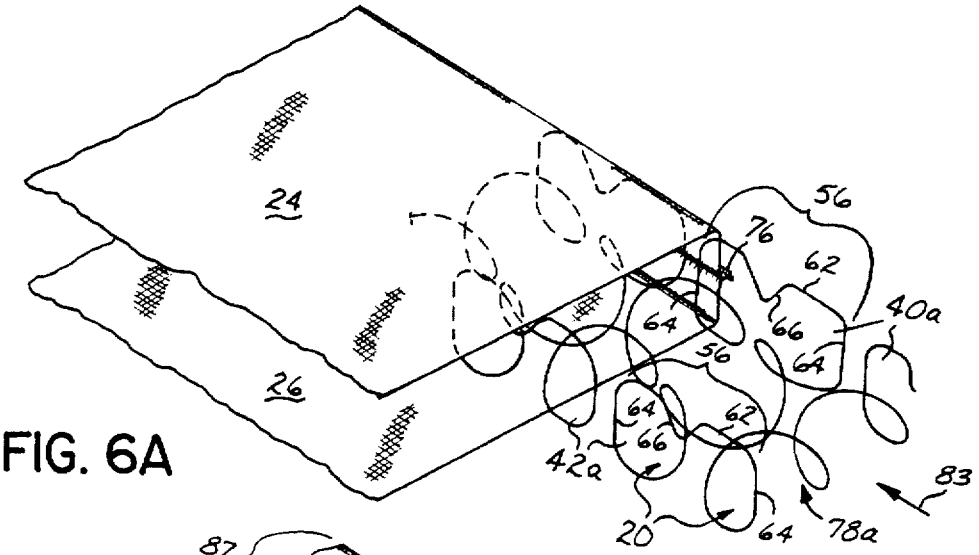
FIGS. 6A–6E are diagrammatic perspective views of the process of manufacturing and assembling the spring assembly of FIG. 1.

FIGS. 6A through 6E illustrate the method of making the pocketed coil spring assembly of the present invention. For the sake of simplicity the numbers used in FIGS. 6A–6E are identical to those used to describe the assembled mattresses in FIG. 1. As seen in FIG. 6A two substantially rectangular sheets of fabric, an upper sheet 24 and a lower sheet 26 are placed in substantially parallel orientation with the upper sheet 24 being slightly above the lower sheet 26. The two sheets 24, 26 are attached along one end edge of the fabric forming a first end line 76. The remainder of the sheets are maintained in a spaced parallel orientation to each other. A first row 78*a* of coil springs 20 are moved horizontally between the two sheets in the direction of arrow 83 such that the upper sheet 24 lies on top of the first row 78*a* of coil springs and the lower sheet 26 lays below the first row 78*a* of coil springs. The first row 78*a* of coil springs 20 may either be a band of coil springs 22 made of one continuous piece of wire as illustrated in FIGS. 6A–E or alternatively may be individual coil springs 20 as illustrated in FIG. 4. The first end turns 40*a* of the coil springs 20 abut the joined first end line 76 whereas the second end turns 42*a* of the coil springs in the first row 78 face rearward opposite the first end turns 40*a*.

Figure 6B:
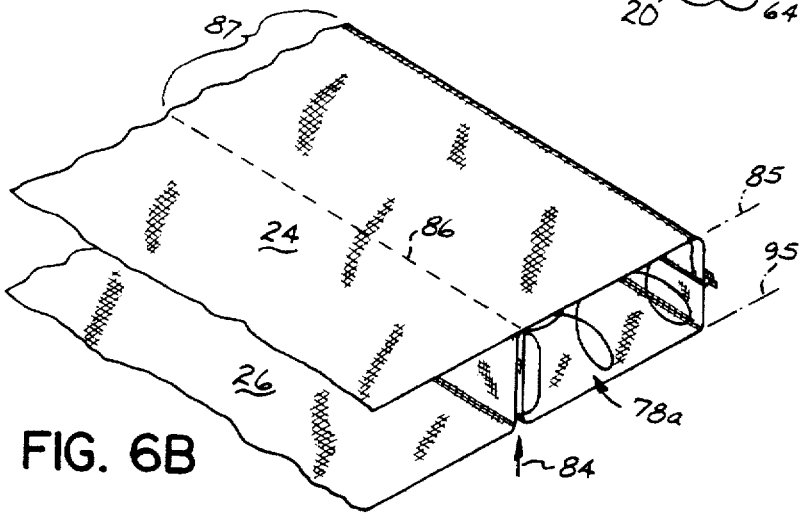

As illustrated in FIG. 6B the lower sheet of fabric 26 is then raised upwardly by, for example, a planar die or roller in the direction of arrow 84 until the fold in the lower sheet 26 meets the upper sheet 24. The sheets are then secured together in the plane 85 of the upper sheet along a first line of attachment 86. A first block 87 is thus created, the block 87 containing the first row 78*a* of coil springs 20. The line of attachment 86 may be a sewn seam, an adhesively secured seam or an ultrasonically welded seam.

Figure 6C:
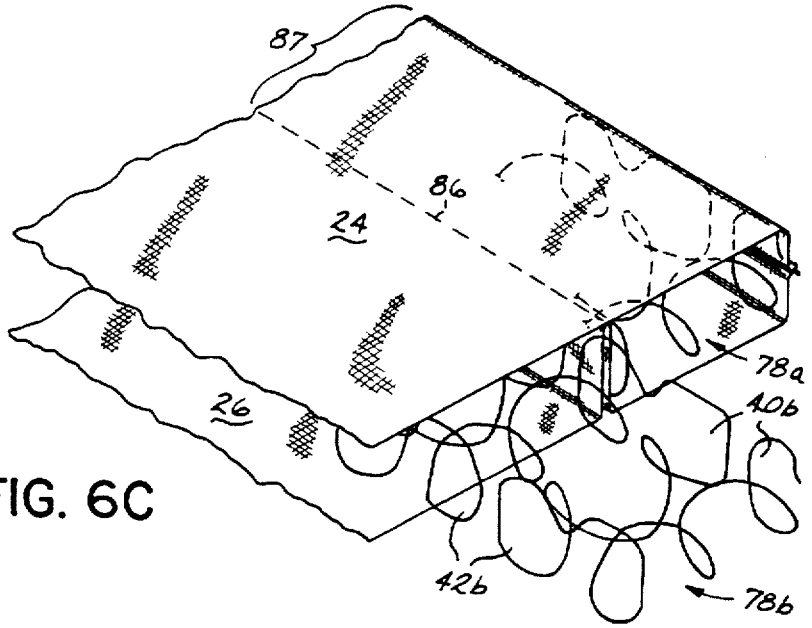

As seen in FIG. 6C, a second row 78*b* of coil springs is then inserted between the sheets 24, 26 in the same manner that the first row 78*a* of coil springs 20 was inserted between the sheets. It is important to note that the first end turns 40*b* of the second row 78*b* face the right edge of the assembly as seen in FIG. 6C and abut the first line of attachment 86. The second end turns 42*b* of the coil springs of the second row 78*b* are located rearwardly (to the left in FIG. 6C) of the first end turns 40*b*. The second end turns 42*a* of the first row 78*a* of coil springs 20 abut the first end turns 40*b* of the second row 78*b* of coil springs. This orientation is necessary so that when the assembly is folded upwards along the lines of attachment into an assembled state the individual blocks are oriented oppositely. See FIGS. 1 and 2.

Figures 6D, 6E:
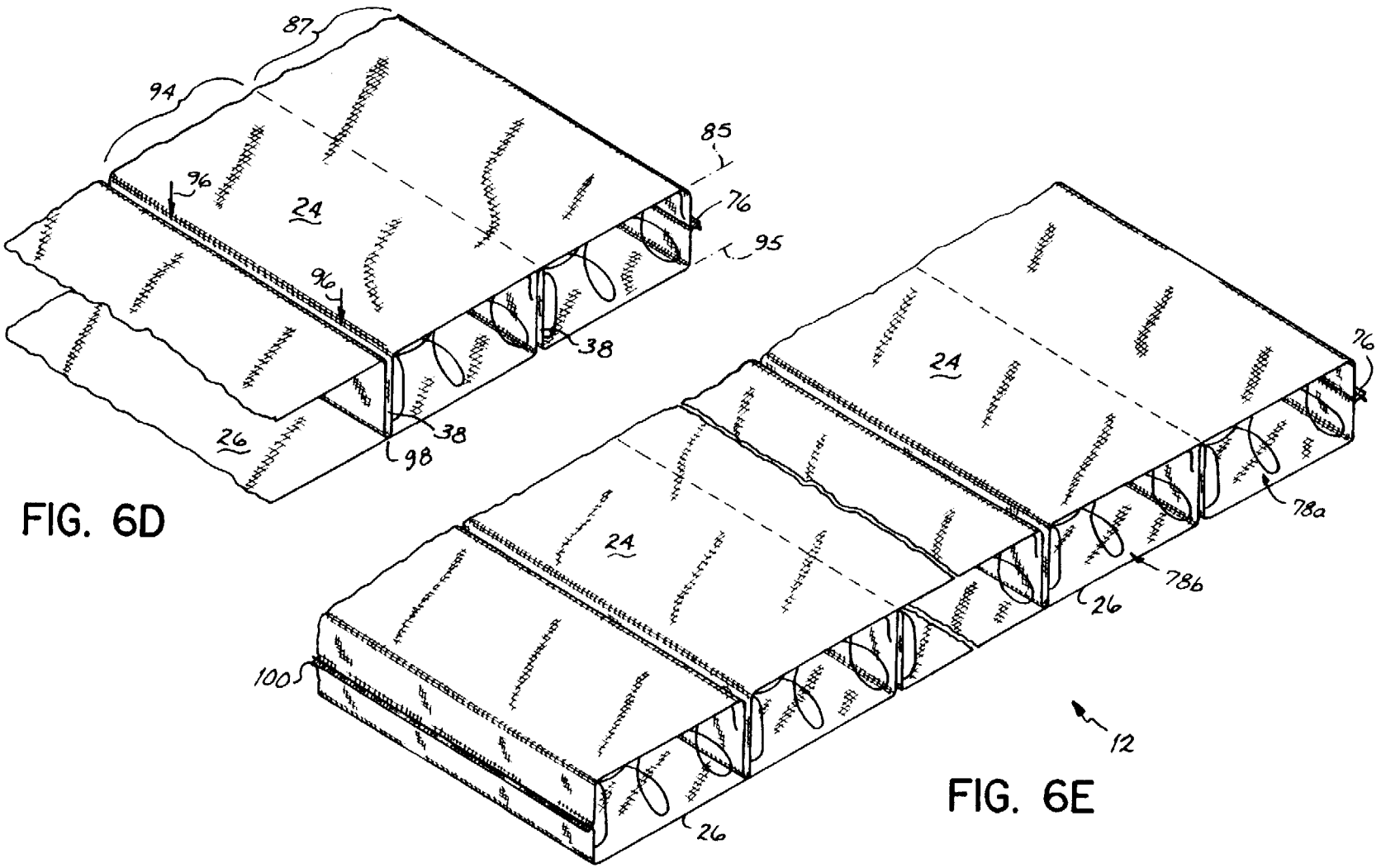

As seen in FIG. 6D a second block 94 is created by lowering the upper sheet of fabric 24 downwardly in the direction of arrows 96 until the resulting fold 38 in the upper sheet 24 abuts the lower sheet 26 in the plane 95 of the lower sheet 26. The sheets are then secured together in the plane 95 of the lower sheet 26 by a second line of attachment 98. As illustrated in FIG. 6D the first and second blocks 87, 94 are secured together by a hinged connection or line of attachment 86 located in the plane 85 of the upper sheet 24 whereas the second and third blocks are connected together in a line of attachment 98 located in the plane 95 of the lower sheet 26. This opposite orientation of the hinged connections allows the assembly to be folded accordion style along the lines of attachment to form the accordion type assembly of the present invention.

As seen in FIG. 6E this process repeats itself until the desired length of the assembly is obtained. Once the desired length of the assembly is obtained the sheets 24.26 are connected together along a second end line 100. The second end line 100 could be located anywhere between the planes 85 and 95.

The assembly is thus completed by folding the flat blocks of pocketed coil springs of FIG. 6E accordion style about the lines of attachment in the manner illustrated in FIG. 2 to create the resulting spring assembly of FIG. 1. This resulting spring assembly may thus be retained in the folded configuration of FIG. 1 by the hog rings 46 located between adjacent blocks 18 as described hereinabove or by conventional border rods 50, 52 secured to the peripheral edge of the assembly in the top and bottom planes thereof. (see FIG. 4).

It is to be noted that when the rows of springs are inserted between the two sheets of fabric 24, 26 as illustrated in FIGS. 6A and 6C, the rows are all similarly oriented as they would naturally be when formed on a commercial conventional spring coiler or spring manufacturing machine. But when folded accordion style about the lines of attachment 86, 98 located alternately in the top and bottom planes of the assembly, the orientation of the springs in adjacent rows is reversed, thereby creating the alternate row orientation of the springs illustrated in FIG. 1.

While we have described only two embodiments of the present invention, one utilizing bands of coil springs and the other utilizing individual coil springs, we do not intend to be limited except by the scope of the following claims:

What claimed is:

1. A method of making a pocketed spring assembly, said assembly having an upper planar surface in a top plane and a lower planar surface in a bottom plane, said assembly comprising a plurality of transversely extending integrally connected fabric blocks, each block containing a plurality of coil springs, each coil spring having first and second end turns and a plurality of central convolutions extending between said end turns and defining an axis, which method comprises the steps of:

vertically spacing two sheets of fabric so the sheets are generally parallel, attaching said sheets of fabric together along one end edge, inserting a first row of coil springs between said sheets such that the first end turns of said first row of coil springs abuts said end edge, attaching said sheets together along a transversely extending first line of attachment adjacent the second end turn of said first row of coil springs in one of said planes to form a block, inserting a second row of coil springs between said sheets such that the first end turns of said second row of coil springs abuts said first line of attachment, attaching said sheets together along a second transversely extending line of attachment adjacent the second end turns of said second row of coil springs in the other of said planes; and repeating said steps of inserting rows of coil springs and attaching said sheets together in alternate planes until an appropriate length of said assembly is obtained.

2.The method of claim 1 which includes the further step of folding said blocks about said lines of attachment so as to place the axes of the coil springs in each block parallel with the axes of the coil springs in the other blocks.

3. A method of making a pocketed spring assembly having an upper planar surface in a top plane and lower planar surface in a bottom plane, said assembly comprising a plurality of transversely extending integrally connected fabric blocks, each block containing a plurality of coil springs arranged in a transversely extending row, which method comprises the steps of:

vertically spacing two sheets of fabric so the sheets are generally parallel, connecting said sheets along one end edge of said assembly, inserting a row of coil springs between said sheets, securing said sheets together along a transversely extending line of attachment in one of said planes such that said sheets form a block, said block containing said row of coil springs, repeating said steps of inserting a row of coil springs and securing said sheets together in alternative planes, connecting said sheets along the other end edge of said assembly.

4. The method of claim 3 which includes the further step of folding said blocks about said lines of attachment so as to compact said assembly.

5. A method of making a pocketed coil spring assembly, said assembly comprising a plurality of transversely extending integrally connected fabric blocks, each block containing a band of coil springs, each coil spring having a first and second end turn and a plurality of central convolutions extending between said end turns and defining an axis, said method comprising the steps of:

vertically spacing a first and second generally rectangular sheet of fabric, each sheet having opposed end edges, said first sheet being in a first plane and said second sheet being in a second plane, connecting one end edge of each of said sheets to each other along a first end line, inserting a first band of coil springs between said sheets, said first end turns of said coil springs abutting said first end line, securing said sheets together along a first transversely extending line of attachment in one of said planes, forming a transversely extending block containing said first band of coil springs, inserting a second band of coil springs between said sheets such that said first end turns of said coil springs abuts said first line of attachment, said second band of coil springs being oriented the same as said first band of coil springs so that upon the folding of said assembly adjacent bands of coil springs are oppositely oriented, securing said sheets together along a second transversely extending line of attachment in the other of said planes, repeating said steps of inserting rows of coil springs and attaching said sheets together in alternative planes until a desired length of said assembly is obtained.

6. The method of claim 5 which includes the further step of folding said blocks accordion style about said lines of attachment so as to compact said assembly.

* * * * *